US006743087B2

(12) United States Patent
Abe et al.

(10) Patent No.: US 6,743,087 B2
(45) Date of Patent: Jun. 1, 2004

(54) COIN HOPPER WITH COIN ANTI-JAMMING COMPONETS

(75) Inventors: Hiroshi Abe, Iwatsuki (JP); Masayoshi Umeda, Iwatsuki (JP)

(73) Assignee: Asahi Seiko Co., Ltd., Tokyo (JP)

( * ) Notice: Subject to any disclaimer, the term of this patent is extended or adjusted under 35 U.S.C. 154(b) by 194 days.

(21) Appl. No.: 10/055,281

(22) Filed: Jan. 23, 2002

(65) Prior Publication Data

US 2002/0090906 A1 Jul. 11, 2002

(30) Foreign Application Priority Data

Jan. 24, 2001 (JP) ..... 2001-015444
May 1, 2001 (JP) ..... 2001-134574

(51) Int. Cl.[7] ..... G07D 1/00
(52) U.S. Cl. ..... 453/57; 453/18; 221/184
(58) Field of Search ..... 453/57, 63, 18, 453/55; 232/44, 55; 220/890; 221/167, 168, 183, 184

(56) References Cited

U.S. PATENT DOCUMENTS 520,550 A * 5/1894 Wile et al. ..... 221/184
1,641,672 A * 9/1927 Goebel et al. ..... 221/184
4,822,318 A * 4/1989 Okada ..... 453/57
5,067,928 A * 11/1991 Harris ..... 453/17
5,695,395 A * 12/1997 Ota et al. ..... 453/57
6,193,599 B1 2/2001 Kurosawa et al. ..... 453/57

FOREIGN PATENT DOCUMENTS

JP 656861 8/1984 ..... G07D/1/00
JP 445085 10/1992 ..... G07D/1/00

* cited by examiner

*Primary Examiner*—Donald P. Walsh
*Assistant Examiner*—Mark J. Beauchaine

(57) ABSTRACT

A coin dispensing apparatus having a coin hopper for storing bulk coins in a rotating disk coin selector mounted at a lower portion of coin hopper is provided. An overload prevention support member can extend above and across the rotating coin selector unit, and can be vertically movable, while being supported by the vertical walls of the coin hopper. A plurality of support members can be mounted within the coin hopper. An agitator member can be mounted to extend upward from the rotating disk coin selector to agitate the stored coins, and, in one embodiment, to contact the overload prevention support members and drive them upward to assist in removing a bearing weight from the rotating disk coin selector.

23 Claims, 11 Drawing Sheets

PRIOR ART

COIN HOPPER WITH COIN ANTI-JAMMING COMPONETS

BACKGROUND OF THE INVENTION

The present invention is directed to a coin dispensing apparatus utilizing a coin hopper for storing bulk coins, and more particularly, to improvements to prevent coin blockage and jamming of a coin selector which dispenses individual coins from the coin hopper.

DESCRIPTION OF RELATED ART

Coin dispensing devices have been frequently utilized in arcades, casinos, change dispensing machines, vending machines, etc. In such devices, coins, medallions, tokens, and similar devices are stored in bulk and selectively removed from storage, counted, and dispensed to a user.

Various examples of coin dispensers with coin hoppers are known, such as disclosed in U.S. Pat. No. 6,193,599 and Japanese Laid Open Patent Application No. 6-56861 (1994). In the Japanese Laid Open Patent Application, as shown in FIG. 11, a coin bowl of a rectangular configuration was connected to a cylindrical lower bowl portion having a coin selecting rotating disk located at the lower portion of the coin bowl. A flexible or elastic cantilevered member was mounted adjacent the interface of the upper and lower portion of the coin bowl and extended horizontally outward and above the rotating disk.

Referring to FIG. 11, the coin hopper 1 has a coin bowl 4 mounted on a slanting substrate 3 which, in turn, is fixed to a support bracket 2. The coin bowl 4 has an upper rim that is rectangular in shape. A rotating disk selector 5 is shown by a dotted line and is located in the cylindrical portion of the lower part of the coin bowl 4. The cantilevered bar 7 is fixed to the upper part of the coin bowl 4 above the rotating disk. The rotating selector disk 5 is utilized to dispense individual coins from the bulk coins stored in the coin hopper 1. An upper rectangular extending bowl 6 is fixed to the upper part of the coin bowl 4, as shown in dotted lines. When coins are stored in the extended bowl 6, they can be partially supported on the cantilever member 7 to thereby reduce the pressure at the bottom of the coin bowl 4. The cantilever member 7 has an elastic spring which can change position depending on the weight of the coins.

There is still a desire in the prior art to improve, in a cost efficient manner, the storage and dispensing of bulk coins from a coin hopper in a coin dispensing apparatus that can minimize coin blockage.

SUMMARY OF THE INVENTION

The present invention provides a coin dispensing assembly having a coin storage unit, such as a coin hopper and a coin selector unit for removing coins from the coin storage unit. A support member, such as an overload prevention bar, is supported across the coin selector unit and is capable of bearing the weight of a portion of the coins above the coin selector unit. The support member can be relatively rigid and mounted to enable a predetermined vertical movement within the storage unit. The support member can be journaled within elongated vertically oriented slots in the walls of the coin hopper. Additionally, a second support member or overload prevention bar can be similarly mounted in the coin storage unit.

A coin selector unit, which can include a rotating disk with appropriate apertures or configurations on the disk to assist in selecting and segregating individual coins for dispensing, is mounted at the bottom of the coin storage unit to receive a gravity feed of the bulk stored coins. A rotating helical unit can extend above the coin selector unit and can include a vertically extending shaft directly connected to the coin selector unit for rotation therewith and a helical coil member mounted about the shaft. The helical coin member can be a metallic or plastic spring-like member that extends along the length of the vertically extending shaft. The vertically extending shaft can be positioned, for example, between the respective support members that are journaled for vertical movement in the walls of the coin storage unit and are spaced approximately half the diameter of the desired sized coin or token from the rotating helical unit. The support members can include rods that are journaled within the coin storage unit walls and sleeves that can rotate with or about the rods. The components that provide these anti-jamming coin features can easily be replaced if they become worn during a maintenance of the coin dispenser assembly.

BRIEF DESCRIPTION OF THE DRAWINGS

The exact nature of this invention, as well as its objects and advantages, will become readily apparent from consideration of the following specification as illustrated in the accompanying drawings, in which like reference numerals designate like parts throughout the figures thereof, and wherein.

DETAILED DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the coin dispensing art, since the general principles of the present invention have been defined herein specifically to provide a coin dispenser assembly with anti-jamming features.

The present invention is directed to lessening the possibility of a coin jam or blockage in a coin storage unit, such as a hopper bowl for dispensing coins from a coin selector unit mounted at the base of the bowl. Thus, when the coin bowl has a significant number of bulk coins stored within the coin bowl, the present invention is designed to lessen the possibility of a jam, which can require down time of the coin dispensing apparatus and expensive labor charges for accessing the coin jam and relieving the situation.

In the present invention, the term "coins" has been utilized in a generic manner to include not only metallic coins of a monetary value, but also medallions, tokens, medals, etc. that can be stored in bulk and individually dispensed to the user.

While the present invention is disclosed in two embodiments, it should be appreciated that the various components of the present invention, separately and in combination, can provide advantageous features for addressing the problem. For example, a single support bar of a configuration disclosed herein can assist in lessening the chance of coin jamming. Utilization of a plurality of support bars appropriately positioned at a distance from each other can provide further improvement. The use of a rotating helical unit extending above a coin selector unit also provides advantageous features and it's use in combination with support bars appropriately positioned can further lessen the possibility of a jamming of the coins to be dispensed. Since the weight of coins that are applied to a selecting rotating disk is lessened, there is less wear and maintenance problems associated with the coin selector unit. A smaller output motor can be utilized for rotating the coin selector unit thereby reducing both costs and the expenditure of energy. Additionally, the components of the present invention have been designed for easy replacement, if they become worn during the course of use, thereby facilitating maintenance of a coin dispenser assembly utilizing the present invention.

Figure 1:
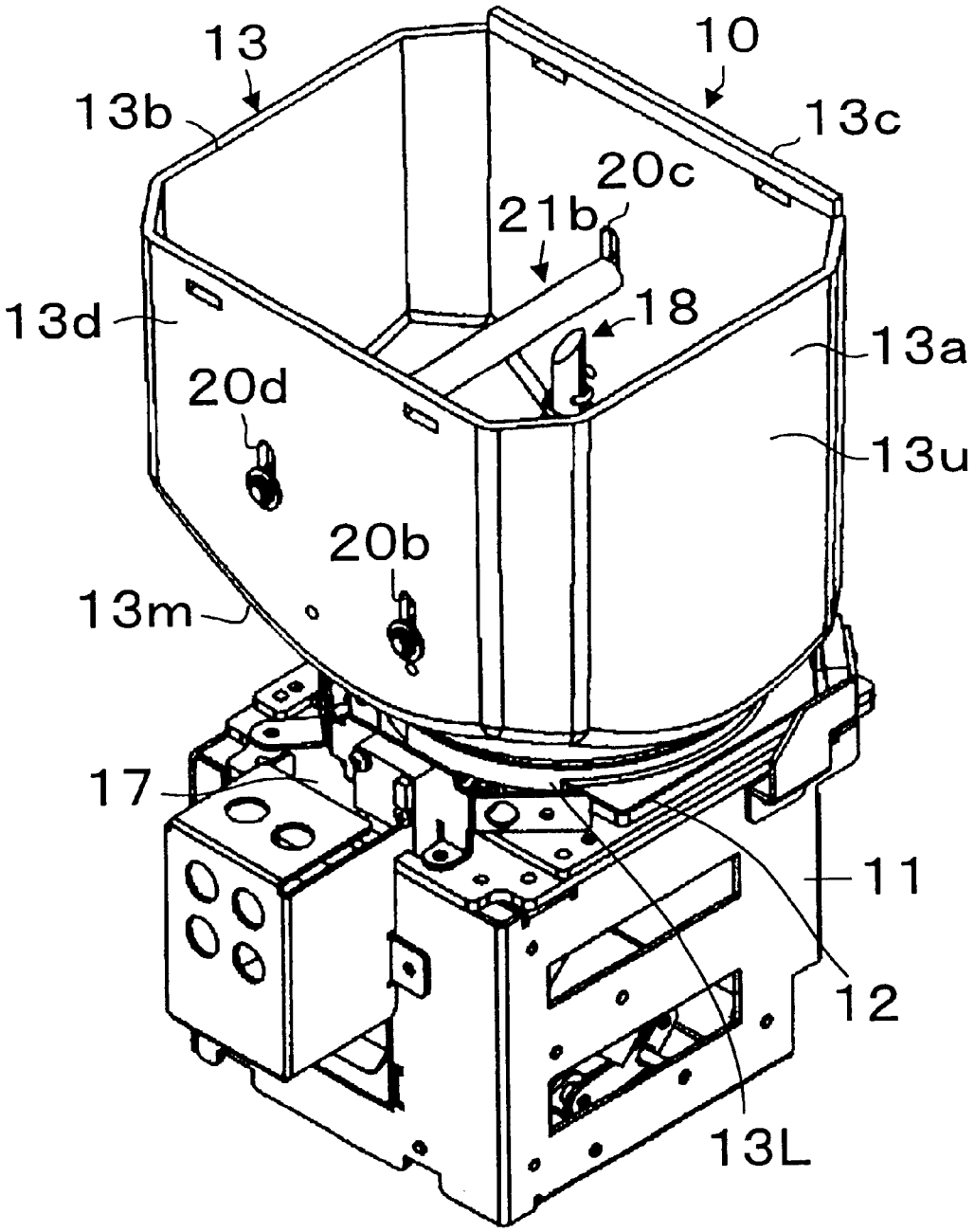
FIG. 1 is a perspective view of a first embodiment of the present invention.

Referring to FIG. 1, a coin hopper 10 of a configuration designed for a gravity feed of bulk coins is disclosed. A basal plate 12 is fixed to a frame bracket 11 of a box-like shape. Coin bowl 13 has a cylindrical-like shape and is mounted to the upper surface of the basal plate 12. The upper portion 13*u* of the coin bowl 13 has a rectangular configuration that merges into a cylindrical configuration as it passes from a middle portion 13*m* to a lower portion 13L.

Figure 2:
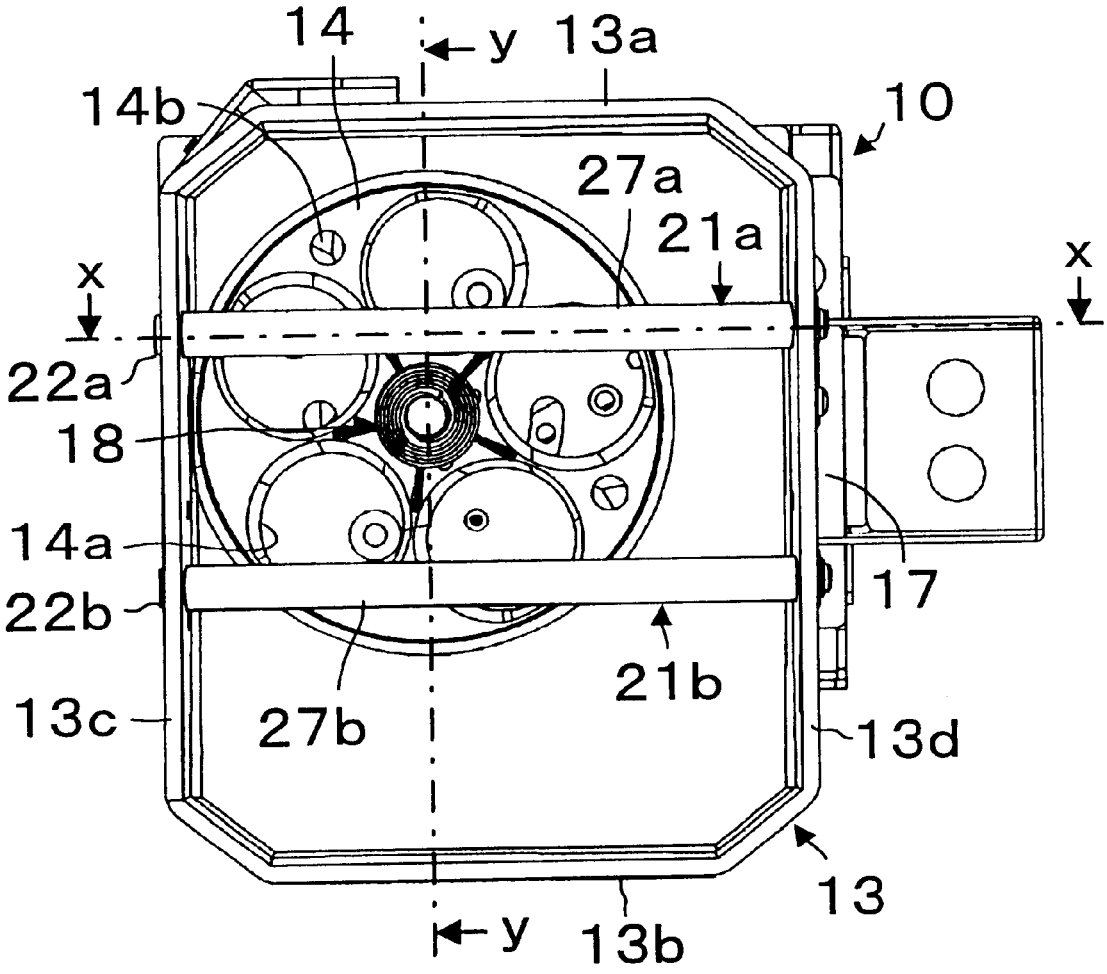
FIG. 2 is a plan view.

A rotating coin selector unit can be seen in FIG. 2. In this embodiment, the coin selector unit can comprise a rotating selector disk 14 having circular apertures for receiving coins. The rotating selector disk 14 is located in the lower part 13L and is level in a horizontal plane. A motor, such as an electric motor (not shown), can drive a speed reduction gear assembly 15 in FIG. 3, which is fixed to the lower surface of the basal plate 12. In turn, the rotating selector disk 14 is connected to the shaft 16 of the speed reducer assembly 15.

The upper part 13*u* of the coin bowl 13 can comprise a first sidewall 13*a*, a second sidewall 13*b*, a third sidewall 13*c*, and a fourth sidewall 13*d*. The first sidewall 13*a* is located away from an edge of the rotating selector disk 14 by about half of a coin diameter and extends vertically upward. The second sidewall 13*b* (shown in FIG. 3) is located away from the edge of the rotating disk by about 1½ times a coin diameter and again, is vertical and positioned opposite the first sidewall 13*a*. The third sidewall 13*c* is located near the edge of the rotating selector disk 14 and is vertical, while the fourth sidewall 13*d* is located away from the edge of the rotating selector disk 14 by about one coin length in diameter and is opposite to the third sidewall 13*c*.

The total coin storage space 13*e* is contained within the respective sidewalls, the middle section 13*m*, and the rotating coin selector disk 14.

The rotating selector disk 14 can further comprise an indented hole 14*a* and several projections. The projections are triangular in shape and are located at the upper surface. The rotating selector disk 14 has coin pockets 14*c* which are located below the arranging hole 14*a*. These coin pockets 14*c* receive the coins and dispense them to a predetermined position. An opening (not shown) is formed by the connection between the coin exit 17 at the lower part of the coin bowl 13L and is opposite to the coin pockets.

In this embodiment, an agitator unit 18 is affixed to the top of the shaft 16. The agitator unit 18 can consist of a vertically extending shaft or rod 18*a* with a coil helical member 18*b* having a spindle-like shape. The agitator rod 18*a* can be made from a flexible resin and it's lower end can be inserted into the top of the center of the rotating selector disk 14 and is appropriately affixed. The agitator rod 18*a* can be mounted within a hollow internal portion of the coil spring 18*b* and it's upper portion can be affixed to the coil spring 18*b* by clamping, while it's lower part can be loosely mounted to the agitator rod 18*a*.

Figure 3:
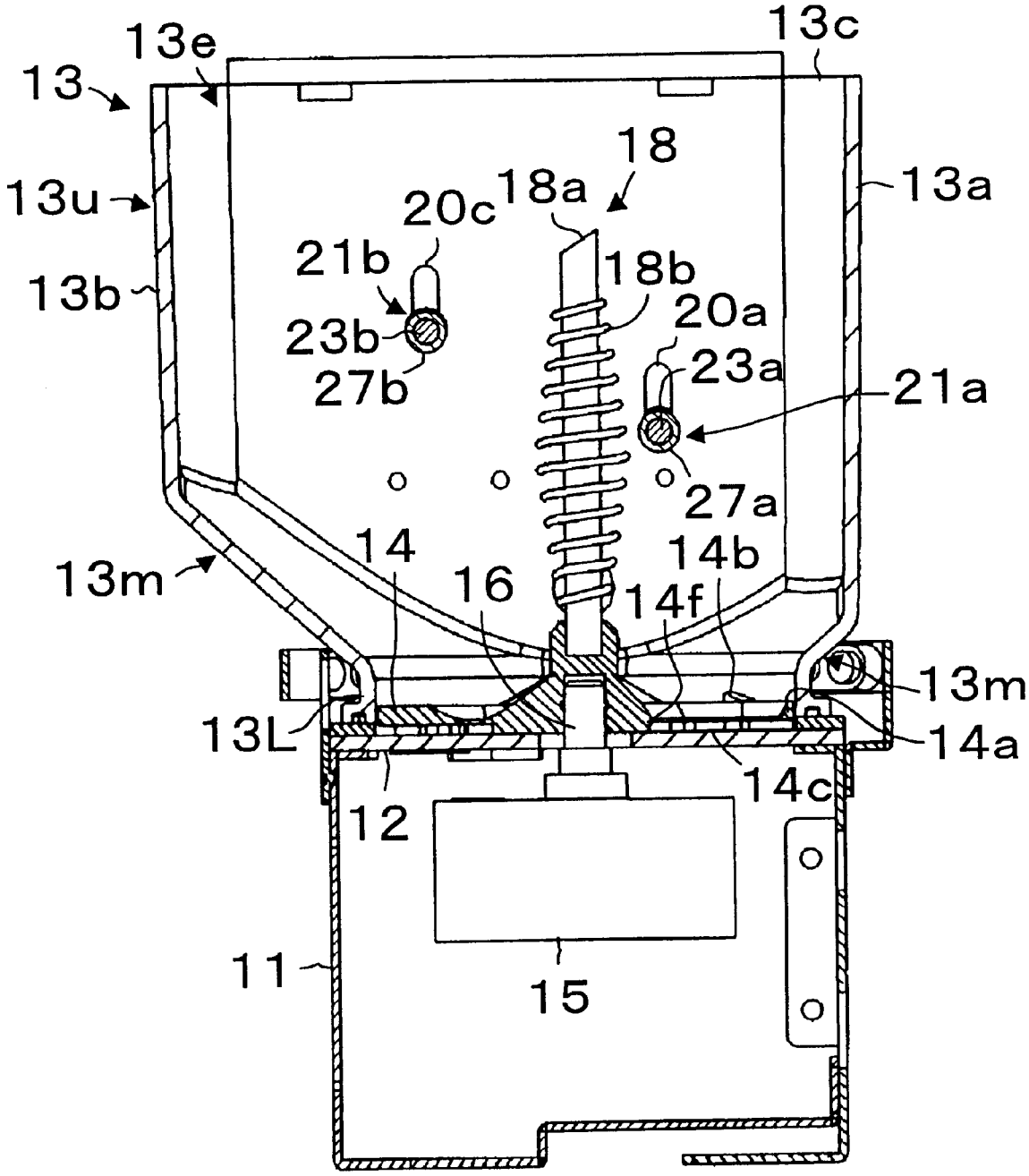
FIG. 3 is a cross-sectional view along the plane Y—Y in FIG. 2.

As seen, for example, in FIGS. 1 and 3, elongated apertures or slots 20*a*, 20*b*, 20*c*, and 20*d* are appropriately provided in the sidewalls. These elongated holes or slots 20*a*–20*d* are appropriately positioned on opposite sidewalls 13*c* and 13*d* so that support members, such as overload prevention bars 21*a* and 21*b*, can be mounted to move vertically within the slotted holes. Alternatively, the holes may be mounted to provide a slanted vertical movement. While a pair of support members 21*a* and 21*b* are disclosed, it can be appreciated that at least one is utilized to provide some support of the weight of coins above the overload prevention bar to achieve the advantages of the present invention. It is also possible to have a plurality of overload prevention bars, such as three.

Figure 4:
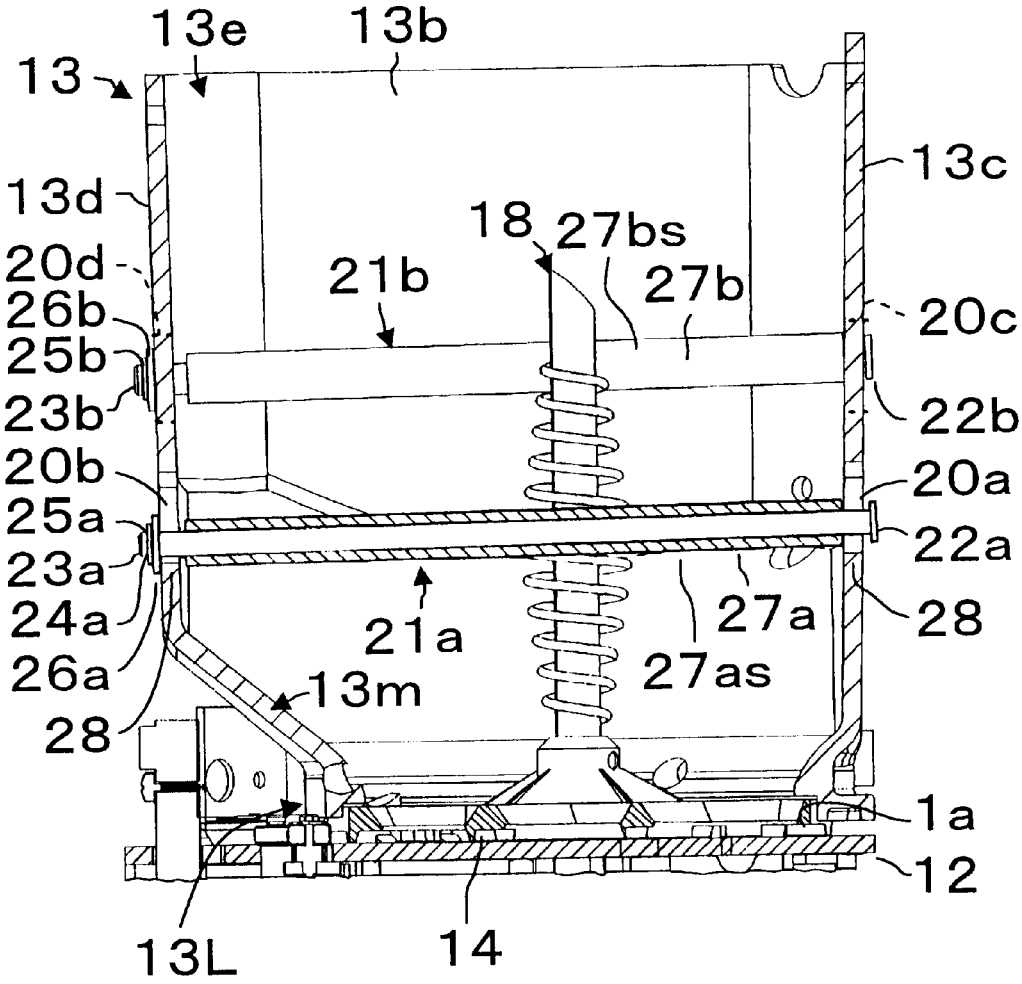
FIG. 4 is a cross-sectional view along the plane X—X in FIG. 2.
Figure 5:
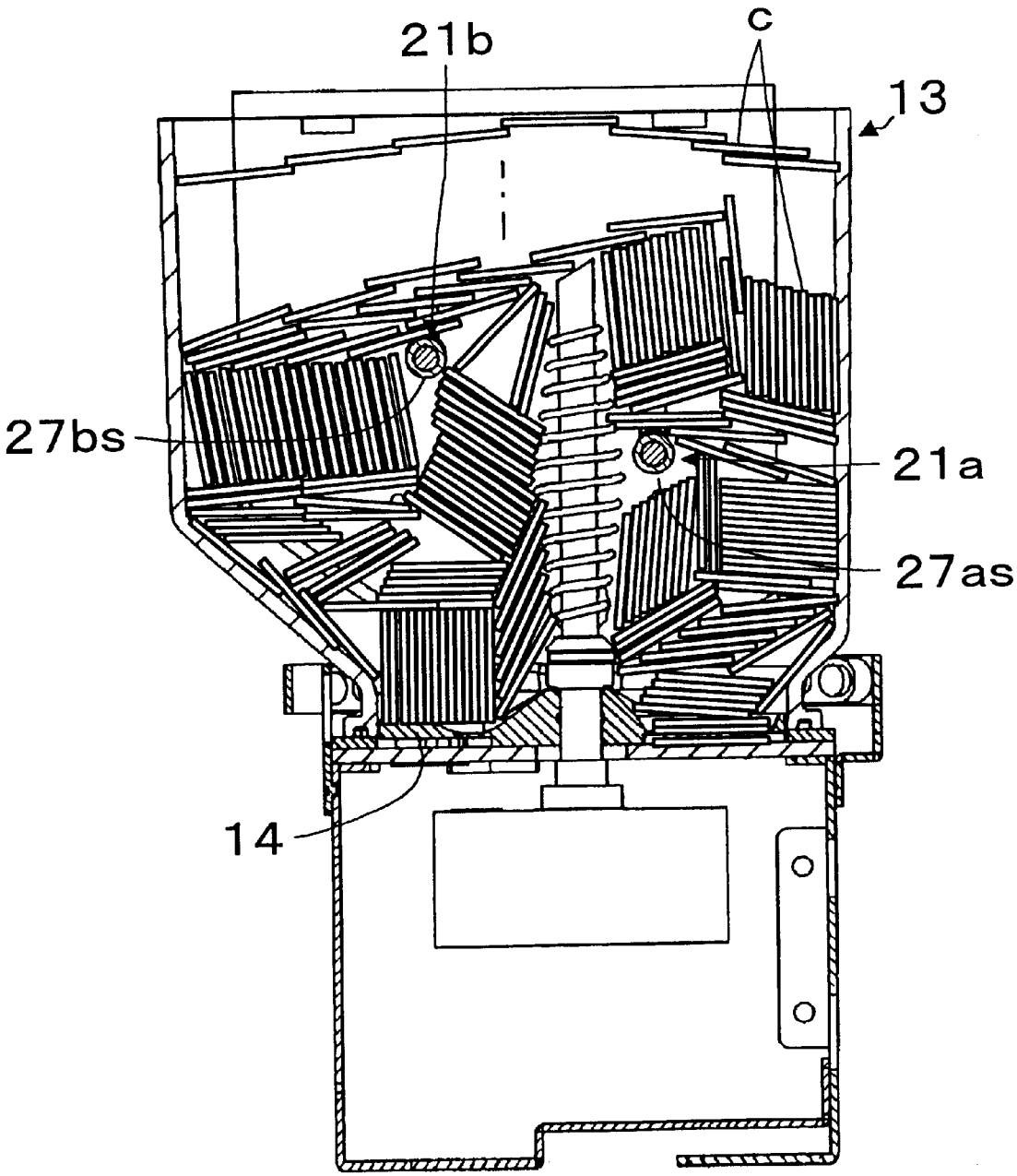
FIG. 5 is a cross-sectional explanatory view.
Figure 6:
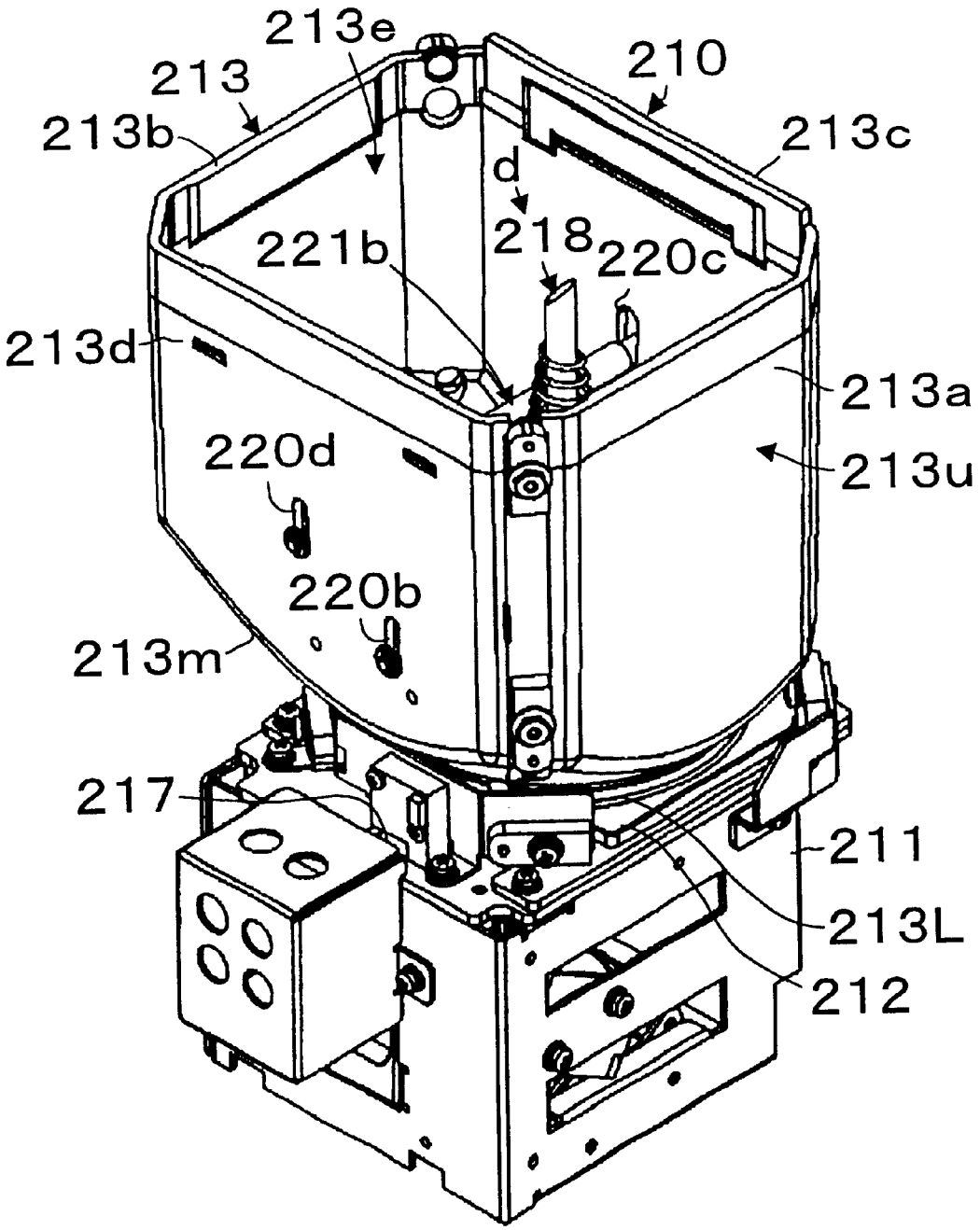
FIG. 6 is a perspective view of a second embodiment of the present invention.

Referring to FIG. 4, a mounting assembly of the overload prevention bars is shown. The same mounting elements are used for both support member 21*a* and support member 21*b*. A round shaft 23*a*, 23*b* has a large head end 22*a*, 22*b* that pierces through a first elongated slot 20*a*, 20*c* and then crosses the coin storage portion 13*e* of the coin bowl 13 above the rotating coin selector unit and extends through the second elongated slot 20*b*, 20*d*. A snap hook 25*a*, 25*b* can be fitted onto a groove 24*a* of the projecting end of the round shaft 23*a*. A washer 26*a*, 26*b* is located between the snap hook 25*a*, 25*b* and the fourth sidewall 13*d*. The round shaft 23*a*, 23*b* can be made from stainless steel and is relatively rigid. An outer cylinder 27*a*, 27*b* which can also be made from stainless steel or other material, is fitted on a middle part of the round shaft 23*a*, 23*b*.

This mounting arrangement permits the support members to be supported at either end in the elongated slots and to move vertically within the elongated slots while still being rigid to support a portion of the weight of the coins above the support bars and to distribute those forces to the sidewalls of the coin hopper. Additionally, the support members can rotate within the elongated slots to further reduce any contact friction with the coins. Thus, a contact surface 27*as* for a sleeve or outer cylinder 27*a* will provide minimal friction contact.

The first support member or overload prevention bar 21*a* is located about 1½ times the diameter of a coin away from the first sidewall 13*a* and is positioned to be located over the inner edge 14*f* of the arranging hole 14*a* shown in FIG. 3. The distance between the first overload prevention bar 21*a* and the first sidewall 13*a* is at least half the diameter of a coin so that coins can easily pass through this area without any build up. The first support member 21*a* is further positioned about two times the diameter of a coin above the upper surface of the rotating disk 14. Thus, the first overload prevention bar 21*a* is located approximately in the middle of the vertical direction of the coin bowl 13. Since each of the support members or overload prevention bars 21*a*, 21*b* are journaled within elongated vertical slots, they are vertically movable. A stopper 28 is provided at the lower end of the elongated slot 20*a* and the elongated end of the slot 20*b*. Alternatively, the stopper can be constructed by a removable stop piece, which can be attached to provide an adjustable vertical distance, depending on the size of the coins. A similar stopper is provided for the support member 21*b*.

The second support member, or overload prevention bar 21*b*, is located two times the diameter of a coin away from the second sidewall 13*b*. This position is approximately over the middle of the radius of the rotating coin selector disk 14. The relative horizontal distance of the first support member or overload prevention bar 21*a* and the second support member or overload prevention bar 21*b* is about two times the diameter of a coin. This distance can be shortened to approximately the diameter of a coin, if necessary.

The second overload prevention bar 21*b* is located approximately at the middle of the vertical height of the coin bowl 13 and about the diameter of a coin away from the first overload prevention bar 21*a* in the vertical direction. By providing the position of the respective first overload prevention bar 21*a* and the position of the second overload prevention bar 21*b* at a difference in their vertical heights, any coins that contact the first overload prevention bar 21*a* will be tilted to slide downward and thereby avoid any bridging effect of coins between the respective support bars.

As shown in FIG. 3, the agitator unit 18 is further located between the first overload prevention bar 21*a* and the second overload prevention bar 21*b*. The overload prevention bar 21*a* is closely located to be adjacent to the intermediate length of the coil spring 18*b*. The second overload prevention bar 21*b* is located relative to the upper portion of the coil spring 18*b*.

The operation of the first embodiment can be explained as follows. Coin storage space 13*e* is filled by bulk coins c to extend to the upper opening, the coins extending over the first support member or overload prevention bar 21*a* and the coins above have a portion of their weight supported by the overload prevention bar 21*a*. Also, the coins positioned above the second support member or overload prevention bar 21*d* are likewise partially supported. Since the respective overload prevention bars are rigid, they can pass the support weight of the coins to the respective sidewalls of the coin hopper. As a result, the rotating selector disk 14 receives a reduced amount of weight of the total coins contained within the coin hopper 13. When the coin hopper 10 is in operation, coins c, which have contact with the rotating selector disk 14, are agitated, and when specific coins become horizontally level, they can pass through the arraying hole 14*a*, which is located at the coin pocket 14*d*. Coins c which enter the pockets 14*c* are moved by the rotating selector disk 14 and are subsequently and sequentially dispensed from the coin exit 17. The remaining coins in the coin storage space 13*a* are moved downwards by gravitational forces.

The coins c that are stored in the coin hopper can fall through three different sections. First, they can fall between the first sidewall 13*a* and the first overload prevention bar 21*a*; secondly, coins can fall between the first and second overload prevention bars 21*a* and 21*b*; and thirdly, between the second overload prevention bar 21*b* and the sidewall 13*b*. The buildup of coins may occur also in the three different sections. First, they can build up between the first overload prevention bar 21*a* and the middle part 13*m*; secondly, the coins can build up between the first and second overload prevention bars 21*a* and 21*b*; and thirdly, the coins can build up between the second overload prevention bar 21*b* and the middle part 13*m*.

The buildup of coins, however, is broken up by the change in coin positions, which slide on the slanted plane of the middle part 13*m* and/or the forcing transfer caused by the rotation of the agitator unit 18. The outer cylinder 27*a*, 27*b* of the respective overload prevention bars can be easily rotated by the friction caused by the coins c, and as a result, the sliding friction to the coins is relatively small. Thus, the build up of coins does not occur because they are not retained or jammed over the respectively load prevention bars. If there is a tendency for a buildup of coins to occur near the third sidewall of 13*c* and the fourth sidewall of 13*d*, such jam is broken by the rotation of the outer cylinder 27*a*, 27*b* which permits the coins to rotate and slide downward under gravitational pull. If the buildup of coins occur between the first and second overload prevention bars 21*a* and 21*b*, the coins c can slant downward to the right. The coins have contact with the rotating selector disk 14, they can push up the first overload prevention bar 21*a* and the second overload prevention bar 21*b*. This upward movement of the coins below the prevention bars can also cause the overload prevention bar 21*a* to move vertically upward along the first and second elongated slots 20*a* and 20*b*, while the second overload prevention bar 21*b* is moved vertically upward along the third and fourth elongated slots 20*c* and 20*d*. Since the first and second overload prevention bars 21*a*, 21*b* can be easily moved upward, this prevents the occurrence of any jamming of coins below the bars and above the rotating selector disk 14. When a sufficient number of coins have been dispensed, the first and second overload prevention bars 21*a* and 21*b* can move vertically downward to a normal position where they are in contact with stoppers 28. Any buildup of coins above the respective overload prevention bars 21*a* and 21*b* can be further relieved by the rotation of these bars.

As can be determined, relatively inexpensive construction of anti-jamming components of the present invention can be realized. Additionally, an agitator unit can be affixed to a rotating selector disk, thereby not requiring any additional or new driving device. The agitator unit can be positioned between the overload prevention bars and the agitating of the coins plus the relative vertical mounting of the overload bars permits the coins to be agitated and move the bars without jamming the rotating coin selector disk. Since the agitator is flexible and has a spindle-like coil shape, there is some give in the system to accommodate the overload prevention bar when it is supporting a large number of coins.

The present invention can be further modified in that a ball bearing can be attached to the end of the overload prevention bar that can be movably mounted within the elongated slot. As another modification, the rotating coin selector disk can be slightly slanted at an angle and can further have multiple holes.

A second embodiment of the present invention is disclosed in FIGS. 6–10.

A basal plate 212 is affixed to a bracket 211 which is box-like in shape and is horizontally level. Coin bowl 213 which is cylinder-like in shape is affixed to the upper surface of basal plate 212 and comprises an upper part 213*u* which is rectangle like in shape, lower part 213L which is cylinder-like in shape and middle part 213*m* which connects between upper part 213*u* and lower part 213L. Rotating selector disk

214 which has a circular disk-like shape is located in a lower part 213L and is also horizontal. Rotating selector disk 214 is affixed to an upper part of a shaft 216 of speed reducer 215 which penetrates basal plate 212. A speed reducer assembly 215 is affixed to the lower surface of basal plate 12 and is driven by a motor (not shown).

Upper part 213*u* comprises a first sidewall 213*a*, a second sidewall 213*b*, a third sidewall 213*c*, and a fourth sidewall 213*d*. A vertical first sidewall 213*a* is located away from an edge of rotating selector disk 214 by about half of a coin diameter. A second vertical sidewall 213*b* is located away from the edge of rotating disk 214 which is located about twice of a coin diameter away and is located opposite to the first sidewall 213*a*.

Third vertical sidewall 213 is located near the edge of rotating disk 214. Fourth sidewall 213*d* is located away from the edge of rotating disk 214 which is located about one coin diameter away opposite to third sidewall 213*c*. The coin storage space 13*e* is within said sidewalls, middle section 213*m*, and rotating disk 214. Rotating selector disk 214 comprises an arranging hole 214*a* and several projections. The projections are triangular-like in shape and are located at the upper surface. Rotating selector disk 214 has coin pockets 214*c* which are located below arranging hole 214*a*. Pocket 214*c* receives the coins, and dispenses them to the predetermined position. An opening (not shown) is formed by connection of coin exit 217 at lower part 213L and is opposite to coin pockets. Output shaft 216 of reducer assembly 215 is fitted in center hole 214*h* of rotating selector disk 214, and screw rs is screwed to the top of output shaft 216. Adjuster ab like cylinder is screwed to the top of lock screw rs.

Agitator 218 is affixed to the top of adjuster ab. Agitator 218 comprises rod 218*a* and coil spring 218*b* which is spindle-like in shape. The rod 218*a* is made from flexible resin and it's lower end is inserted into the center top of adjuster ab and is fixed. Rod 218*a* is inserted within the hollow of coil spring 218*b* and it's upper part is affixed to the upper part of rod 218*a* by clamping and it's lower part is loose on rod 218*a*.

First elongated hole 220*a*, which extends in the vertical direction, is located on third sidewall 213*c* next to first sidewall 213*a* of coin bowl 213. Second elongated hole 220*b*, which extends in the vertical direction, is located on fourth sidewall 213*d* which is opposite to first elongated hole 220*a*. Third elongated hole 220*c*, which extends in the vertical direction, is located on third sidewall 213*c* next to second sidewall 213*b*. Fourth elongated hole 220*d*, which extends in the vertical direction, is located on fourth sidewall 213*d*, which is opposite to the third elongated hole 220*c*. First overload prevention bar 221*a* can move up and down in the first elongated hole 220*a* and the second elongated hole 220*b*. Second overload prevention bar 221*b* can move up and down in the third elongated hole 220*c* and fourth elongated hole 220*d*. First and second overload prevention bars 221*a* and 221*b* may be moved in a slanted position. Therefore, a pair of first and second elongated holes 220*a* and 220*b*, and a pair of third and fourth elongated holes 220*c* and 220*d* can be slanted. First overload prevention bar 221*a* and second overload prevention bar 221*b* are the same structure in design, and a description will be provided for only the first overload prevention bar 221*a*. Round shaft 223*a*, which has a large head, and 222*a* pierces through first elongated hole 220*a* and crosses into a coin storage space 213*e* of coin bowl 213 and pierces a second elongated hole 220*b*. Snap hook 225*a* is fitted in groove 224*a* of the projection end of round shaft 223*a*. Washer 226*a* is located between snap hook 225*a* and fourth sidewall 213*d*. As a result, round shaft 223*a* does not move in the horizontal direction by fourth sidewall 213*d* and washer 226*b*. The end of round shaft 223*b* is located in second elongated hole 220*c* and it can slide vertically up and down. Round shaft 223*a* is made from stainless steel and is rigid. First outer cylinder 271*b* and second outer cylinder 227*b* which are made from stainless steel or another appropriate material are fitted with the middle part of round shaft 223*b* which is located in coin storage 213*e*. First outer cylinder 271*b* and second outer cylinder 272*b* are rotated with round shaft 223*b*. Second overload prevention bar 221*b* is combined with round shaft 223*a* and first outer cylinder 271*b* and second outer cylinder 271*c* to become rigid. Outer surface 227*bs*, which can rotate, is the surfaces of the first and second outer cylinders 271*b* and 272*b*. Alternatively, first outer cylinder 271*b* and second outer cylinder 272*b* may be made as only one cylinder.

Figure 7:
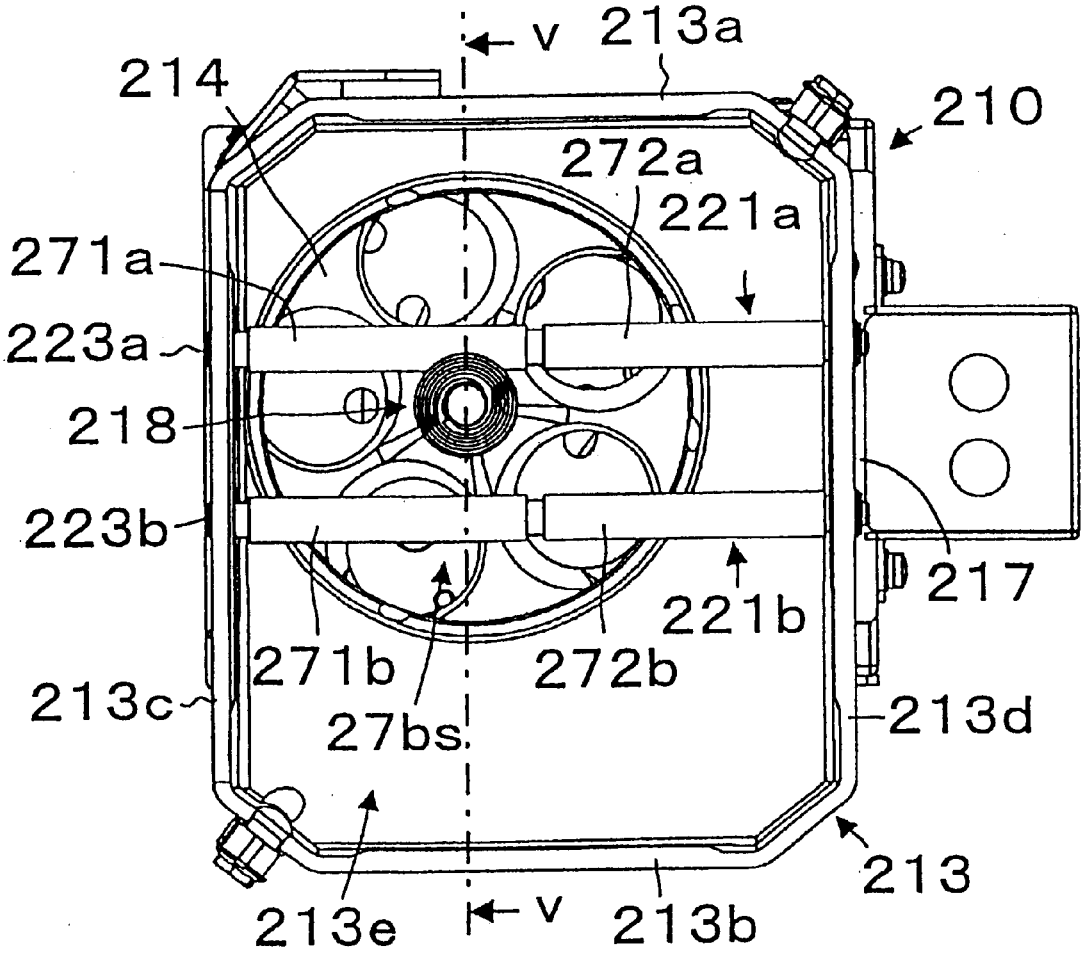
FIG. 7 is a plan view.

The round surface of first outer cylinder 271*a* and first overload prevention bar 221*a* has contact with coil spring 218*b* of agitator 18. In another case, the round surface of second outer cylinder 272*a* may also have contact with coil spring 218*b*. In another case, if coil spring 218*b* is bent by coins c, the round surface of second outer cylinder 272*a* may have contact with coil spring 218*b*. First and second overload prevention bar 221*a* and 221*b* may be only the first and second round shaft 223*a* and 223*b*. First overload prevention bar 221*a* is desirable located away from first sidewall 213*a* about a coin diameter in distance. The position of first overload prevention bar 221*a* is located at a center side of an inner edge 214*f* of arranging hole 214*a* as shown in FIG. 7. First overload prevention bar 221*a* is desirable, because it is located away at least half of a diameter of a coin from the first sidewall 213*a*, because the coins can pass through this area without coin build up. First overload prevention bar 221*a* is located above about two times a diameter of a coin away from the upper surface of rotating disk 214, in other words, first overload prevention bar 221*a* is located at a middle of vertical height of coin bowl 213. First overload prevention bar 221*a* can be located lower, because the coin's position may change.

Stopper 228 is the lower end portion of the first elongated hole 220*a* and second elongated hole 220*b*, because round shaft 223*a* is stopped by the lower edge of the first elongated hole 220*a* and the second elongated hole 220*b*. Stopper 228 can be constructed by a stop piece which could be attached to third sidewall 213*c* and fourth sidewall 213*d* to provide an adjustable vertical height. Therefore, round shaft 223*a* is supported by the stop piece. Also, the second overload prevention bar 221*b* can use a similar stopper.

Second overload prevention bar 221*b* is located to three times diameter of a coin away from second sidewall 213*b* over the middle of the radius of rotating disk 214. A distance which is between the first overload prevention bar 221*a* and second overload prevention bar 221*b* is desirable because it is about one diameter of a coin. However, this distance is at least a diameter of a coin, because the build up of coins does not occur as a result of the first and second overload prevention bar 221*a* and 221*b*.

Second overload prevention bar 221*b* is located at a middle of vertical height of coin bowl 213 and is located above about a diameter of coin away from first overload prevention bar 221*a*. When the position of first overload prevention bar 221*a* and the position of second overload prevention bar 221*b* differ, if any coins have contact with the first overload prevention bar 221*a*, the coins slide downward, because the coins are on a slant.

Agitator 218 is located between the first overload prevention bar 221 a and the second overload prevention bar 221*b* and contacts with the first outer cylinder 271*a* which is the outer surface of first overload prevention bar 221*a* as shown in FIG. 7. First overload prevention bar 221*a* is closely below and in contact with the coil spring 218*b*. Outer surface 227*as* is in contact with the coil spring 218*b*. Second overload prevention bar 221*b* is located spaced from helical coils of spring 218*b*. The winding direction of coil spring 218*b* is that first overload prevention bar 221*a* is lifted by rotating coil spring 218*b*.

Figure 10:
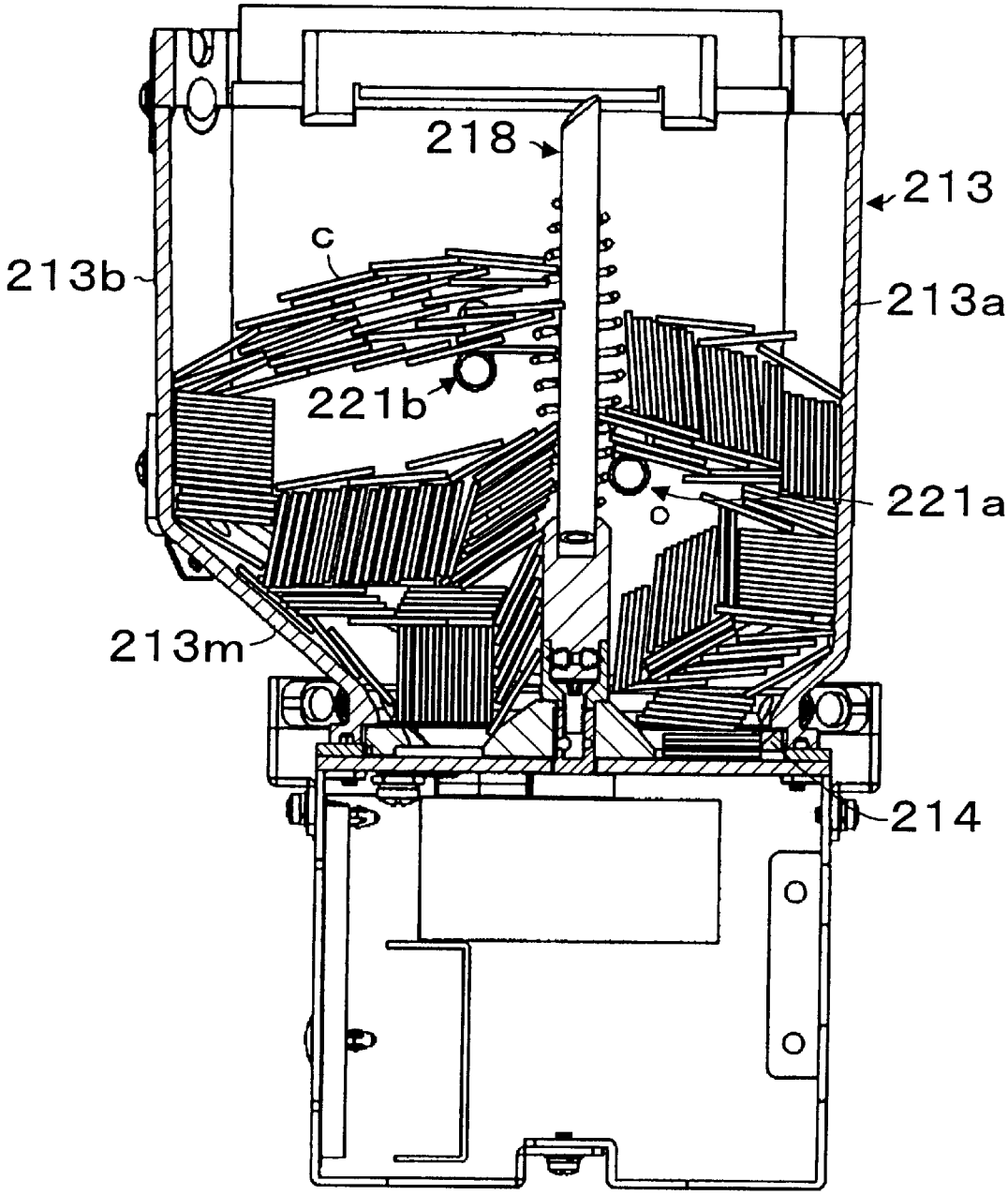
FIG. 10 is an explanatory view of a second embodiment.
Figure 11:
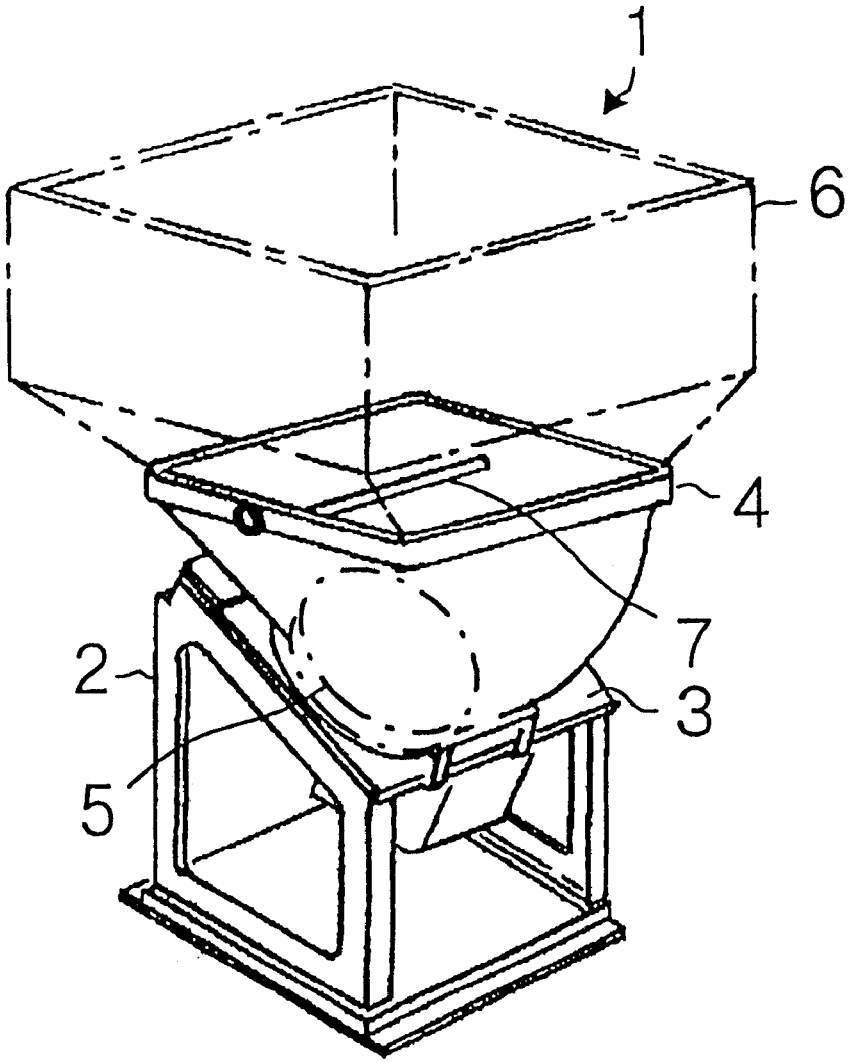
FIG. 11 is a partial perspective view of a prior art coin hopper.

The operation of the second embodiment is explained by reference to FIG. 10. Before the operation starts, coin storage space 213*e* is filled by bulk coins c to the upper opening. In this situation, the coins on first overload prevention bar 221*a* and the coins above are supported by first overload prevention bar 221*a*. Also, the coins on the second overload prevention bar 221*b* and the coins above are supported by second overload prevention bar 221*b*. Rotating selector disk 214 receives the weight load which subtracts the weight supported by first overload prevention bar 221*a* and second overload prevention bar 221*b* from the total weight of coins in coin storage space 213*e*. As a result, the load on rotating disk 214 is reduced drastically.

When coin hopper 210 is in operation, coins c, which have contact with the rotating selector disk 214, are agitated. As a result, when the coins at the bottom become level, they pass through arraying hole 214*a*, which is located at pocket 214*d*. Coins c, which are at pocket 214*c*, are moved by rotating selector disk 214 and are dispensed from coin exit 217.

Coins c in coin storage space 213*e* are moved downward by gravitation. Coins c can fall through in three different sections, first, between the first sidewall 213*a* and first overload prevention bar 221*a*, secondly, between the first and second overload prevention bar 221*a* and 221*b*, and third, between the second overload prevention bar 221*b* and second sidewall 213*b*. The build up coins may occur in three different sections, first, between overload prevention bar 221*a* and middle part 213*m*, second, between the first and second overload prevention bar 21*a* and 21*b*, third, between the second overload prevention bar 21*b* and middle part 13*m*. The coins c, which are over middle part 13*m* of coin storage space 213*e*, move towards the right by the slant of middle part 13*m* as shown in FIG. 10. Agitator 18, when inclined by said coins, moves to the right. As a result, it is rotating and inclining. As a result of the slant of agitator 18, first overload prevention bar 221*a* is located in the area between coils of coil spring 218*b*. The first overload prevention bar 221*a* is lifted up by rotating coil spring 218*b*. If the volume of coins is large, the first overload prevention bar 221*a* is not lifted by coil spring 218*b*. However, if the volume of coins is small, the first overload prevention bar 221*a* is lifted by coil spring 218*b*. When coil spring 218*b* pushes up the first overload prevention bar 221*a*, it receives an opposite force from the first overload prevention bar 221*a*, and is bent. As a result, coil spring 218*b* may come out of contact with the first overload prevention bar 221*a*. The first overload prevention bar 221*a*, which is not supported by coil spring 218*b* falls down, and is stopped by stopper 228. Afterwards, coil spring 218*b* has contact with first overload prevention bar 221*a* again, because it returns by a self restoring biasing force and/or is pushed by coins c. First overload prevention bar 221*a* is moved up by coil spring 218*b* as stated previously and is moved down by coins c.

The situation of coins c, which contact the first overload prevention bar 221*a*, is changed by the up and down motion of first overload prevention bar 221*a*. As a result, any build up of coins does not occur since they are thrown off balance by bar 221*a*. The build up of coins c may occur in three different sections, first, between the first overload prevention bar 221*a* and middle part 213*m*, second, between the first overload prevention bar 221*a* and the second overload prevention bar 221*b*, and third, between second overload prevention bar 221*b* and middle part 213*m*. However, any build up of coins c is broken by a change in the coin's position, because first overload prevention bar 221*a* is moved in the vertical direction by coil spring 218*b*.

The sliding friction is small because first outer cylinder 271*a* and 271*b* and second outer cylinder 272*a* and 272*b* are easily rotated by friction from coins c. As a result, the position of coins c is easily changed.

Figure 8:
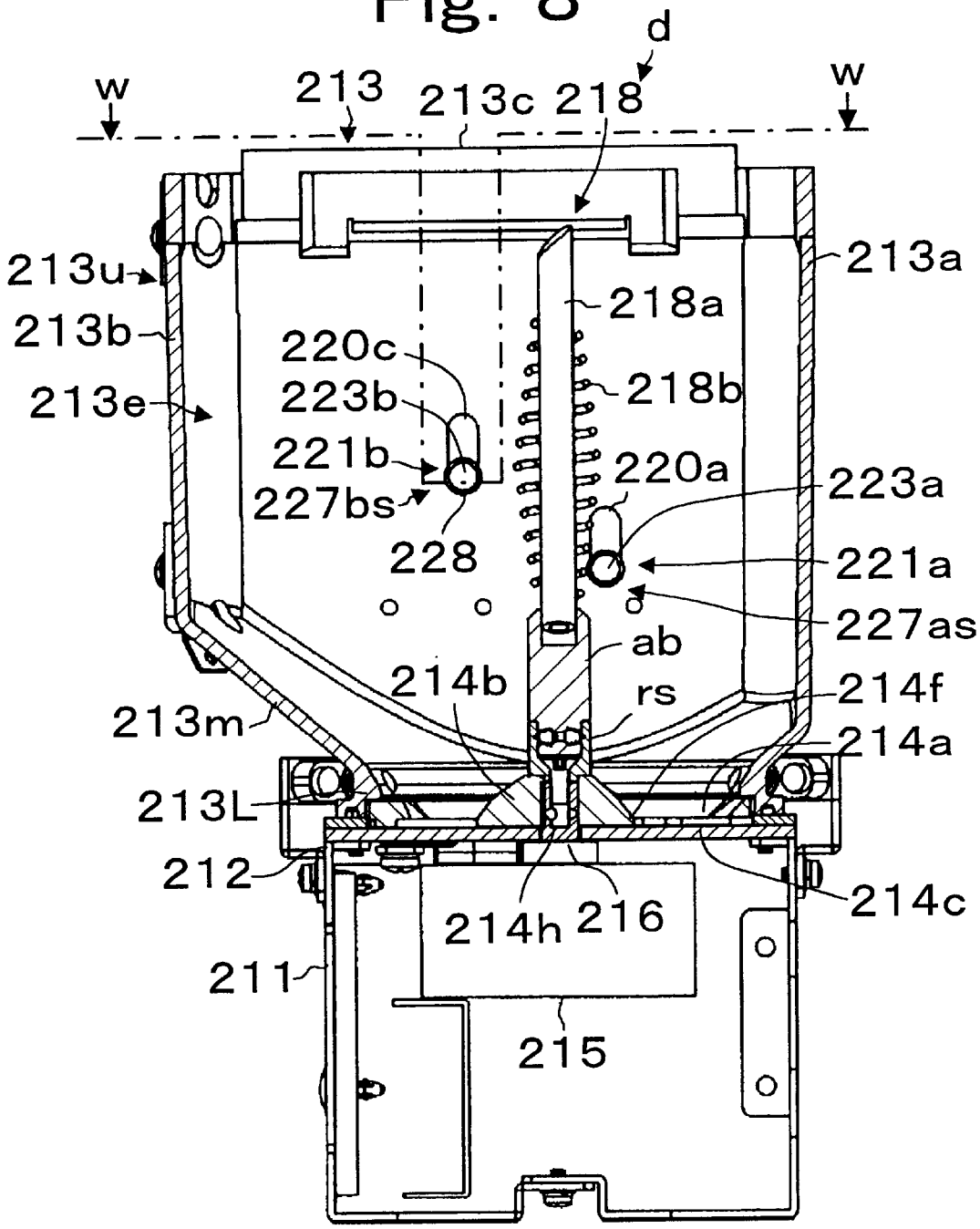
FIG. 8 is a cross-sectional view taken along the plane V—V of FIG. 7.
Figure 9:
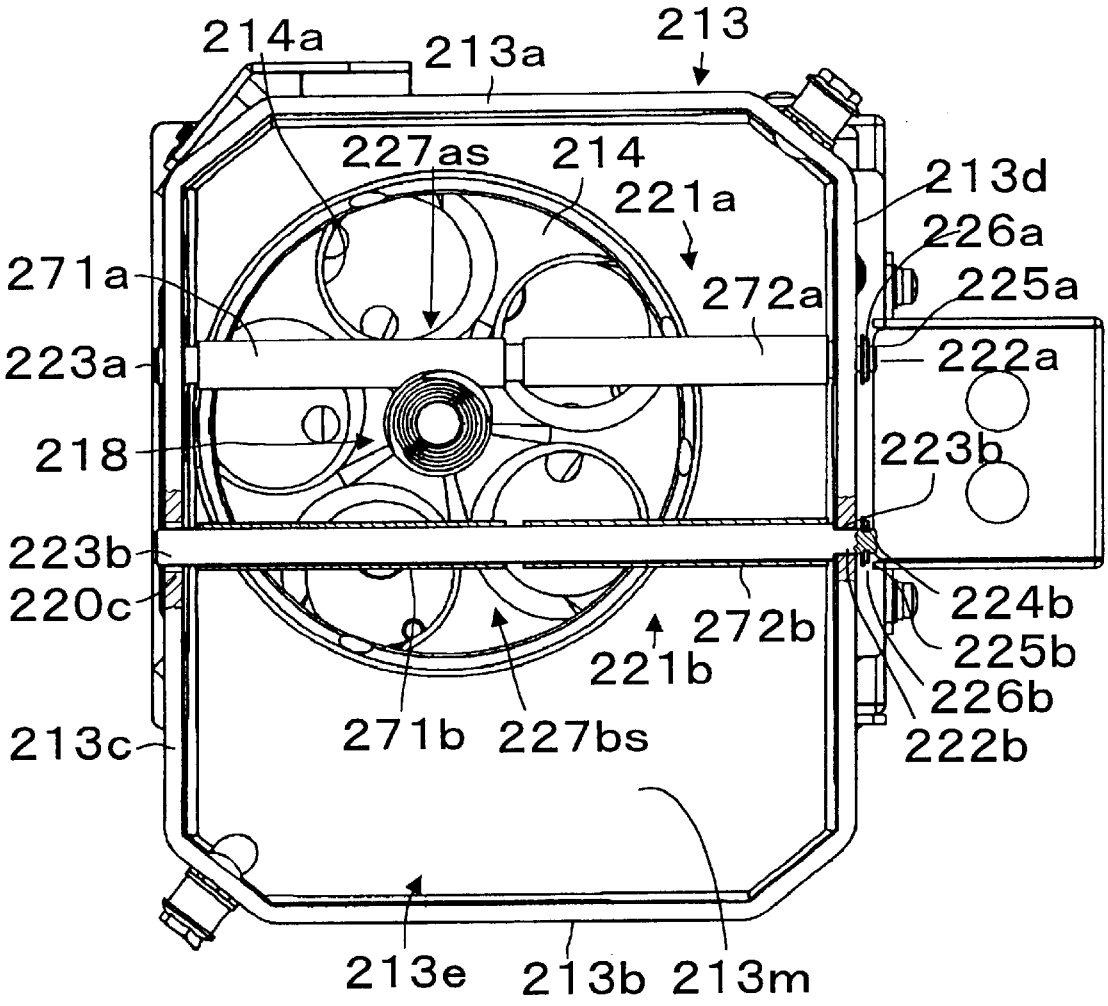
FIG. 9 is a cross-sectional view taking along the plane W—W of FIG. 8.

If the build up of coins occur near the third sidewall 213*c* and fourth sidewall 213*d*, it is broken by the rotation of first outer cylinder 271*b* and second outer cylinder 272*b*, which are rotated by coins c, because coins c are forced to move. If the build up of coins occur between the first overload prevention bar 221*a* and second overload prevention bar 221*b*, coins c slant downward to the right as shown in FIG. 8. Coins c move to the right by gravity, and as a result, any build up of coins is broken.

If coins c have contact with rotating selector disk 214, they are pushed up by first overload prevention bar 221*a* and second overload prevention bar 221*b* through several coins c. If a push up force occurs, first overload prevention bar 221*a* is moved up along first elongated hole 220*a* and second elongated hole 220*b*, and second overload prevention bar 221*b* is moved up along third elongated hole 220*c* and fourth elongated hole 220*d*. As a result, the coin jamming of rotating selector disk 14 does not occur, because first overload prevention bar 221*a* and second overload prevention bar 221*b* are moved upward. Afterwards, the first overload prevention bar 221*a* and second overload prevention bar 221*b* are moved back to a normal position by the weight of coins c and are stopped by stopper 228. The build up of coins is broken by the movement of first overload prevention bar 221*a* and second overload prevention bar 221*b*, because any bridging of coins on first overload prevention bar 221*a* and second overload prevention bar 221*b* are broken.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. In a coin dispenser assembly having a coin storage unit and a coin selector unit for removing coins from the coin storage unit, the improvement comprising:

a rotating helical unit extending above the coin selector unit and into the coin storage unit for agitating stored coins, and a support member mounted in the coin storage unit for moving contact with the rotating helical unit.

2. The coin dispenser assembly of claim 1, wherein the helical unit includes a coiled spring member.

3. The coin dispenser assembly of claim 1, wherein the helical unit extends vertically above the coin selector unit.

4. The coin dispenser assembly of claim 3, wherein the support member extends horizontally adjacent the rotating helical unit and is capable of bearing the weight of a portion of the coins above the support member.

5. The coin dispenser assembly of claim 4, wherein the support member is movably mounted within the storage unit.

6. The coin dispenser assembly of claim 5, wherein a second support member is movably mounted within the storage unit and is capable of bearing the weight of a portion of coins above the second support member.

7. The coin dispenser assembly of claim 4, wherein the support member includes a rod member and a rotatable sleeve mounted on the rod member.

8. The coin dispenser assembly of claim 7, wherein walls of the coin storage unit have elongated slots and the rod member is journaled within the slots to permit vertical movement.

9. The coin dispenser assembly of claim 1, wherein the rotating helical unit includes a vertically extending shaft connected to the coin selector unit and rotatable with the coin selector unit and a helical coil member mounted about the shaft.

10. The coin dispenser assembly of claim 9, wherein a plurality of support members extend horizontally adjacent the helical coil member within the coin storage unit and are capable of bearing the weight of a portion of the respective coins above the support members.

11. The coin dispenser assembly of claim 10, wherein the plurality of support members are journaled within the coin storage unit to permit relative vertical movement.

12. The coin dispenser assembly of claim 11, wherein the plurality of support members are positioned at least a half of a stored coin diameter from the rotating helical unit.

13. A coin dispenser assembly comprising:

a storage unit for storing coins in bulk;

a coin selector unit mounted within the storage unit to selectively dispense coins from the storage unit including a rotating member for engaging and separating the coins selected to be dispensed; and a support member which is supported to enable vertical movement within the storage unit to extend across the coin selector unit and is capable of bearing the weight of a portion of coins above the coin selector unit.

14. The coin dispenser assembly of claim 13, wherein the support member can rotate about a horizontal axis.

15. The coin dispenser assembly of claim 14, wherein the support member includes a rod member supported at each end by the storage unit and journaled for relative vertical movement at each end in the storage unit and a rotatable sleeve mounted on the rod member.

16. The coin dispenser assembly of claim 14, further including a vertically extending shaft connected to the rotating member and a helical coil member mounted about the vertically extending shaft and dimensioned to interact with stored coins.

17. A coin hopper comprising:

a coin storage unit for storing bulk coins having approximately vertical walls;

a rotating disk coin selector unit mounted at a lower portion of the coin storage unit for selecting coins for dispensing that contact the coin selector unit as pulled downward by gravity;

an overload prevention support member that extends above and across the rotating disk coin selector unit and is enabled to support a portion of the bulk coin weight, the support member is supported by the vertical walls to be movable in a vertical direction; and a stopper member for limiting the vertical movement of the support member.

18. The coin hopper of claim 17, wherein the overload prevention support member can rotate about a horizontal axis.

19. The coin hopper of claim 18, wherein elongated slots are positioned within the vertical walls to support the overload prevention support member.

20. The coin hopper of claim 19, wherein the overload prevention support member includes a rod member journalled within the elongated slots and a rotatable sleeve mounted about the rod member.

21. The coin hopper of claim 20 further including an agitator member operatively connected to the rotating disk coin selector unit and extending upward adjacent the overload prevention support member to agitate the stored bulk coins.

22. The coin hopper of claim 21, wherein the agitator member includes a coiled member.

23. The coin hopper of claim 17, wherein a pair of overload prevention support members are mounted in the coin storage unit and are vertically offset.

* * * * *